US008043238B1

(12) United States Patent
Tamura et al.

(10) Patent No.: US 8,043,238 B1
(45) Date of Patent: Oct. 25, 2011

(54) DISPOSABLE DECUBITUS PREVENTING AND TREATING MATTRESS WITH ANCILLARY APPLICATIONS

(76) Inventors: Raymond M. Tamura, Honolulu, HI (US); Shigeo Natori, Honolulu, HI (US)

( * ) Notice: Subject to any disclaimer, the term of this patent is extended or adjusted under 35 U.S.C. 154(b) by 0 days.

(21) Appl. No.: 12/803,861

(22) Filed: Jul. 8, 2010

Related U.S. Application Data

(60) Provisional application No. 61/270,630, filed on Jul. 10, 2009.

(51) Int. Cl.
*A61H 23/04* (2006.01)

(52) U.S. Cl. ..... 601/148; 601/150

(58) Field of Classification Search ..... 601/148–152; 128/DIG. 20; 5/710–713
See application file for complete search history.

(56) References Cited

U.S. PATENT DOCUMENTS

| | | | | |
|---|---|---|---|---|
| 2,699,165 | A * | 1/1955 | Ferrier | 601/149 |
| 3,390,674 | A * | 7/1968 | Jones | 601/150 |
| 3,548,809 | A * | 12/1970 | Conti | 601/152 |
| 3,587,568 | A * | 6/1971 | Thomas | 601/149 |
| 4,029,087 | A * | 6/1977 | Dye et al. | 601/152 |
| 5,584,085 | A * | 12/1996 | Banko | 5/710 |
| 7,037,280 | B1 * | 5/2006 | Burns et al. | 601/149 |

* cited by examiner

*Primary Examiner* — Danton DeMille
(74) *Attorney, Agent, or Firm* — James Creighton Wray

(57) ABSTRACT

Two plastic sheets are selectively joined to create parallel air cells with connecting passageways at alternate ends. The sheets form a mattress for full body, back or leg massages. An air pumped reservoir supplies air flow to a fluidic switch. Air from a right arm pushes air to a left leg and sequentially fills a first cell. Alternating passageways at opposite ends of cells sequentially fill the cells. After the last cell is filled, air flowing out from the last cell through a right arm of the switch pushes the supplied air flow to a right leg of the switch for exhaust, emptying the cells. The cycle repeats automatically, sequentially filling the cells and pushing blood toward the heart and then emptying the cells then sequentially filling the cells.

16 Claims, 2 Drawing Sheets

DISPOSABLE DECUBITUS PREVENTING AND TREATING MATTRESS WITH ANCILLARY APPLICATIONS

BACKGROUND OF THE INVENTION

This application claims the benefit of U.S. Provisional Application No. 61/270,630 filed Jul. 10, 2009, which is hereby incorporated by reference in its entirety as if fully set forth herein.

SUMMARY OF THE INVENTION

Decubitus ulcers are pressure sores, commonly called bed sores.

Unlike most mattresses for preventing and treating decubitus ulcers, the new mattress device actively vectors venous blood and lymphatic fluid transversely and perpendicularly across the longitudinal axis of the body as each air cell is inflated.

As each air cell is progressively inflated toward patient's heart, this action in summation vectors venous blood and lymphatic fluid longitudinally to the heart.

This new action of the invention removes carbon dioxide, and all cellular metabolites surrounding the cells.

This new action brings freshly oxygenated blood to the cells.

Since carbon dioxide and metabolites destroy cells, this new action of the invention prevents decubitus ulcers.

This new action allows new cells to form and heal ulcers which had formed prior to use of this device.

Past and present devices usually have air cells pulsating in place. In order to move venous blood and lymphatic fluid toward the heart, those devices must create a wave of pulsating air cells in groups, and that requires computer-controlled air and multiple air tubes. That increases complexity, malfunction and costs thousands of dollars.

To avoid increasing complexity, malfunction and cost, this new device of the invention is powered by a source of moderately high pressure air from an electric pump, or any other source of pressurized air. Only one set of interconnected tubing is required. This device requires only one fluidic (Coanda) switch which controls the cycles of inflation and deflation automatically without computers. No maintenance is required for the switch.

This new mattress device is made of pliable plastic sheets joined at spaced position between the two sheets, forming air cells and connecting plastic tubes. This new mattress is much less expensive than other devices.

For this reason, this device can be washed if it is soiled by food spills, body fluids, blood, urine or feces from an unconscious or bed-ridden patient.

Since plastic ages, it becomes less pliable and may develop cracks. Since the mattress of the present invention is much less expensive than other devices, it easily and economically can be disposed of and replaced with a new progressively inflatable mattress.

Two plastic sheets are selectively joined to create parallel air cells with connecting passageways at alternate ends. The sheets form a mattress for full body, back or leg massages. An air pumped reservoir supplies air flow to a fluidic switch. Air from a right arm pushes air to a left leg and sequentially fills a first cell. Alternating passageways at opposite ends of cells sequentially fill the cells. After the last cell is filled, air flowing out from the last cell through a left arm of the switch pushes the supplied air flow to a right leg of the switch for exhaust, emptying the cells. The cycle repeats automatically, sequentially filling the cells and pushing blood toward the heart and then emptying the cells then sequentially filling the cells.

The invention has a mattress with upper and lower ends. Fluid cells are arranged parallel to the upper and lower ends and fluid passageways sequentially connect the cells. A fluid supply line is connected to a first cell near a lower end, and a fluid exhaust line is connected to a last cell near the upper end.

The mattress comprises plastic sheets having internal joint patterns forming the cells and passageways.

The passageways are connected to alternate ends of the cells, and the fluid flows in a first direction through the first cell, through a first connecting passageway to a second cell, and through the second cell in a second direction opposite to the first direction and in alternate opposite directions through sequential cells.

A source of pressurized air is connected to the fluid supply line, and the fluid cells and passageways are air cells and passageways.

The source of pressurized air is an interrupted source.

The interrupted source comprises an air pump and reservoir and a fluidic switch connected to the reservoir, with a switch body with an outlet, first and second control arms near the outlet and first and second air flow legs spaced from the outlet.

The first leg provides an exhaust. The first arm is connected to provide control air from the reservoir to direct air flow from the outlet to the second leg, the second leg is connected to the supply line, and the second arm is connected to the exhaust line, to supply control air from the exhaust line and the second arm to direct air flow from the outlet to the first leg exhaust.

The mattress has plastic sheets with internal joint patterns forming the cells and passageways. The passageways are connected to alternate ends of the cells. The fluid flows in a first direction through the first cell, through a first connecting passageway to a second cell, and through the second cell in a second direction opposite to the first direction and in alternate opposite directions through the sequential cells.

The invention has two parallel sheets with lower and upper ends and an internal joint pattern for forming parallel air cells, and passageways connecting the cells sequentially from a first lower cell through the passageways and successive intermediate cells to the last upper cell.

A pressurized air supply is connected to the first lower air cell.

An exhaust line is connected to the last upper cell.

The invention has an air exhaust. A fluidic switch is connected to the pressurized air supply, the supply line, the exhaust line and the air exhaust, and is arranged to provide air flow from the air supply through a main outlet and to direct air from the pressurized air supply through a control orifice to direct the air flow from the outlet to the supply line for filling the first lower air cell and the other air cells sequentially. The exhaust line is arranged to direct air flowing out of the air cells through the last upper air cell to an opening adjacent the outlet to direct the air flow from the outlet to the air exhaust.

The plastic sheets form a mattress for a person's body or back or for wrapping around legs.

The method of the invention comprises massaging a body, back or limbs of a person by sequentially filling connected air cells, then emptying the air cells, and again sequentially filling the air cells, followed by emptying the air cells and repeating the sequences.

The filling of the air cells begins with a lower cell and continues upward in sequences through the connected cells. The emptying of the air cells comprises flowing the air out of the cells through an upper cell.

An air pump and a fluidic switch are provided which have a main supply body for supplying cell filling air from the air pump through an outlet. The fluidic switch has a first leg for exhaust and a first arm adjacent the first leg for supplying control air to a main body outlet and directing the cell filling air away from the exhaust and toward a second leg of the switch and to the lower cell. An air cell emptying line is connected to the upper cell and to a second arm of the switch for directing the cell filling air away from the second leg and toward the first leg for exhaust.

The filling comprises directing air flow through an air supply line to the lower cell, and the emptying comprises directing air from the upper cell to a cell emptying line.

Pressurized air flow is supplied through an outlet of a fluidic switch, directing the air flow to the supply line by flowing pressurized air through a control line, impinging on the air flow, and influencing the air flow to the supply line.

The air flow is directed from the outlet to an exhaust by flowing the air from the emptying line toward the air flow from the outlet, impinging on the air flow, and influencing the air flow to the exhaust.

These and further and other objects and features of the invention are apparent in the disclosure, which includes the above and ongoing written specification, with the claims and the drawings.

DETAILED DESCRIPTION OF THE DRAWINGS

Figure 1:
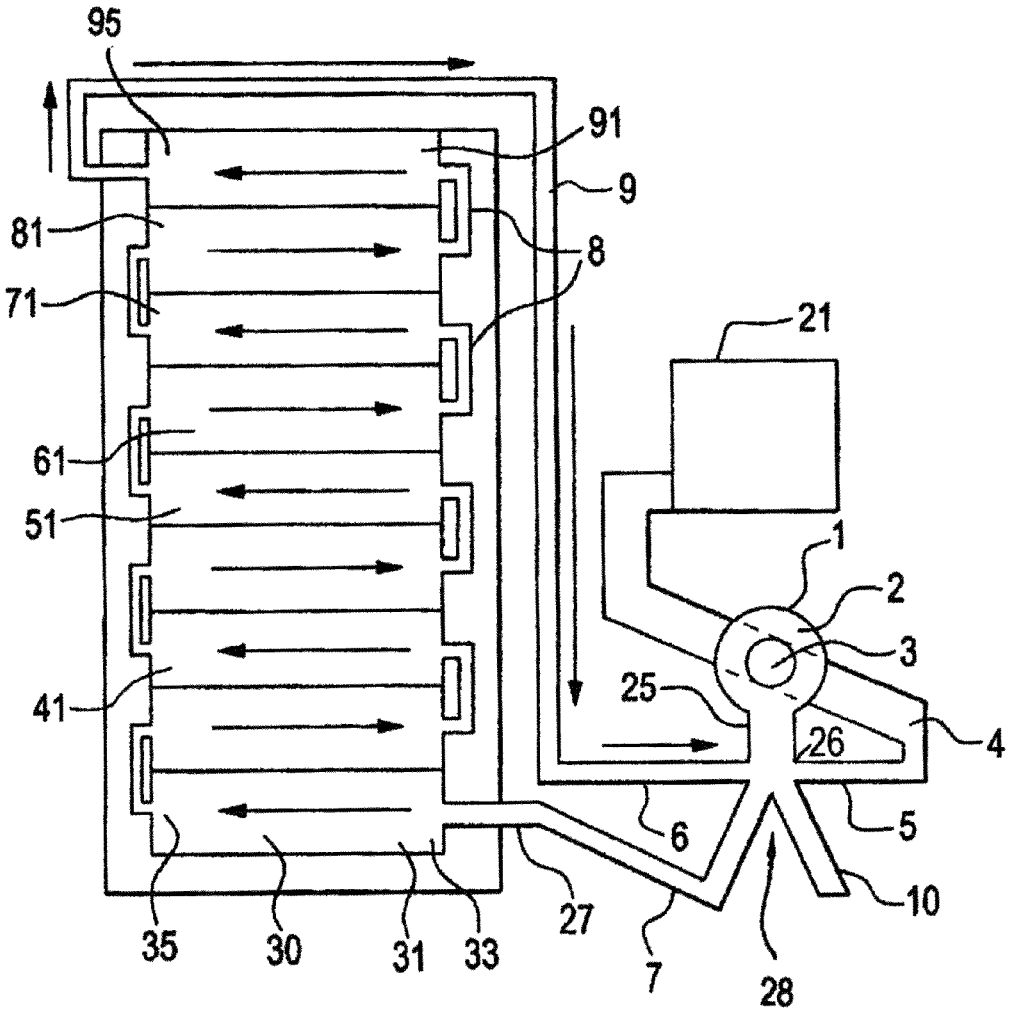
FIG. 1 is a schematic representation of a disposable decubitus preventing and treating mattress.

In FIG. 1, pressurized air is conducted from the electric air pump and reservoir 21 to the fluidic (Coanda) switch 1. Air enters the switch air chamber 2 through the air inlet 3. The air supply tube has an extension 4 which is connected with the right arm 5 of the switch 1. This air from the right arm 5 is directed on the stream of air coming through the body 25 from the air chamber 2. This pushes the air stream from body 25 to the left leg 7 of the switch 1. The air is then conducted by feed tube 27 to the first air cell 31 which inflates from the first end 33 to the opposite second end 35, and this is the first transverse vector 30 for moving venous blood and lymphatic fluid. Each cell 41, 51, 61, 71, 81, 91 is progressively inflated through the connecting tubes 8. When the air reaches second end 95 of the last air cell 91, it is exhausted through exhaust tube 9. Exhaust tube 9 is connected to the left arm 6 of the switch 1. This equals the pressure of the right arm 5. The air stream from the air chamber 2 thus passes straight through the splitter area 28 where the airstream from right arm 5 and the exhaust stream from exhaust tube 9 and the right arm meet. The air stream from air chamber 2 and body 25 of the switch 1 hits the splitter at area 28. The air stream is thus split in half. Pressure in the left leg 7 which is connected to the first air cell 31 falls to half. This, in turn, causes pressure to fall progressively in the cells 31, 41, 51, 61, 71, 81 and 91 and exhaust tube 9. This pressure fall causes pressure fall in the left arm 6. Since pressure in the right arm 5 becomes greater than in the left arm 6, the air stream from the chamber 2 is pushed to the left leg 7, and thus reinflates the first cell 31. The cycles repeat themselves, subsequently sequentially filling and then emptying cells 31, 41, 51, 61, 71, 81 and 91. The filling cycle starts as the air flow from right arm 5 pushes the air flow from air chamber 2 and body 25 into left leg 7.

Figure 2:
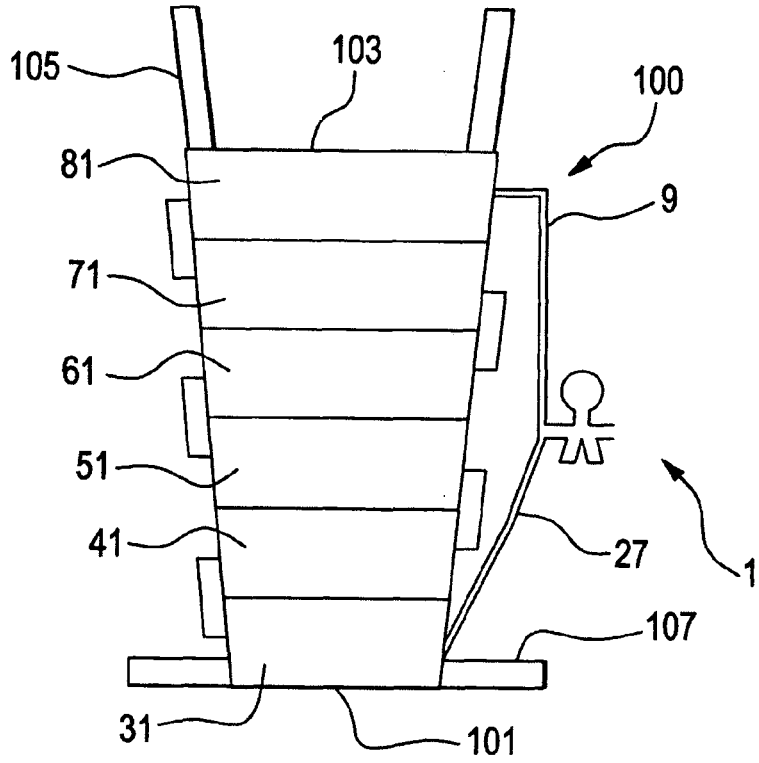
FIG. 2 is a schematic representation of a back massaging mattress.

FIG. 2 shows a back massaging mattress 100. This works on the same principle as the decubitus mattress 10 shown in FIG. 1. Massaging action starts from the lower back 101 up to the shoulder area 103. Air cells 31-81 and tubing are arranged similarly to the decubitus mattress. This is held in place by straps 105 over the shoulder and straps 107 around the trunk and waist. Straps can be held by Velcro connectors.

Figure 3:
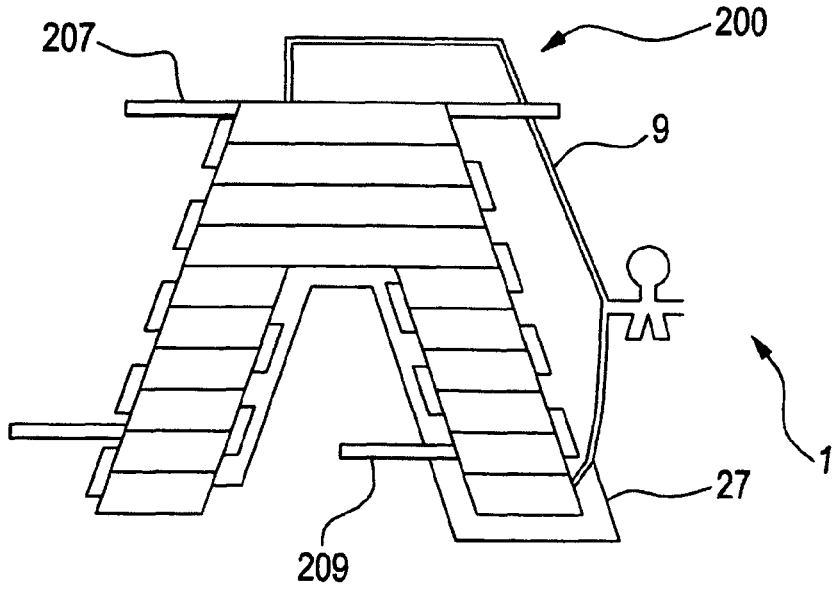
FIG. 3 is a schematic representation of a buttock and leg massaging mattress.

FIG. 3 shows a buttock and leg massaging mattress 200. This works like the back massager 100. It is held by waist straps 207 and leg straps 209 with Velcro connectors. Connecting tubing with feed tubes 27 and exhaust return tube 9 may need to be arranged in a different way since the leg mattresses 210 are separate.

Applications

The foremost reason for this device is its use for patients who have chronic illnesses and/or debilitation whereby they are unable to change position in bed or chair by themselves such as stroke victims, coma from tumor/disease or trauma.

There are also other situations where this device and its modifications or derivatives can be used. FIG. 2 illustrates how it can be used for improving circulation of the lower limbs, buttocks and back for this purpose by those who drive taxis, buses, airline/air cargo/fighter pilots, truck drivers, train engineers or operators of cranes and other equipment. These individuals are required to sit for long hours. Individuals who have had Deep Vein Thrombosis (DVT) will have a tremendous benefit from this device. Those who are at high risk for DVT such as diabetics, hypertensives, and/or early congestive heart failure and fibrillation would also benefit.

Pilots and weapons officers are required to sit for very long hours in a cramped cockpit. Their requirement does not allow use of the torso unit. FIG. 2 shows a unit which extends from buttocks to lower legs. Because this device is essentially flat when not inflated, the spine would not be fractured by the ejection seat if this is activated. In sports this unit can also be used to treat muscle spasm (cramps). There may be other areas of employment which have not yet revealed themselves.

While the invention has been described with reference to specific embodiments, modifications and variations of the invention may be constructed without departing from the scope of the invention, which is defined in the following claims.

We claim:

1. An apparatus comprising:

a mattress having upper and lower ends;

fluid cells arranged parallel to the upper and lower ends;

fluid passageways sequentially connecting the cells;

a fluid supply line connected to a first cell near a lower end; and a fluid exhaust line connected to a last cell at the upper end and using the fluid emptying from the cells to deflect cell-filling fluid to an exhaust, then again sequentially filling the air cells, followed by emptying the air cells and repeating the sequences.

2. The apparatus of claim 1, wherein the mattress comprises plastic sheets having internal joint patterns forming the cells and passageways.

3. The apparatus of claim 1, wherein the passageways are connected to alternate ends of the cells, and the fluid flows in a first direction through the first cell, through a first connecting passageway to a second cell, and through the second cell in a second direction opposite to the first direction and in alternate opposite directions through sequential cells.

4. The apparatus of claim 1, further comprising a source of pressurized air connected to the fluid supply line, and wherein the fluid cells and passageways are air cells and passageways.

5. The apparatus of claim 1, wherein the source of pressurized air is an interrupted source.

6. The apparatus of claim 5, wherein the interrupted source comprises an air pump, reservoir outlet, and reservoir and a fluidic switch connected to the reservoir outlet and having a switch body having an inlet, first and second control arms near the inlet and first and second air flow legs spaced from the inlet.

7. The apparatus of claim 6, wherein the first leg provides an exhaust, the first arm is connected to provide control air from the reservoir to direct air flow from the reservoir to the second leg, wherein the second leg is connected to the supply line, and the second arm is connected to the exhaust line, to supply control air from the exhaust line and the second arm to direct air flow from the reservoir outlet to the first leg exhaust.

8. The apparatus of claim 1, wherein the mattress comprises plastic sheets having internal joint patterns forming the cells and passageways, and wherein the passageways are connected to alternate ends of the cells, and the fluid flows in a first direction through the first cell, through a first connecting passageway to a second cell, and through the second cell in a second direction opposite to the first direction and in alternate opposite directions through the sequential cells.

9. An apparatus comprising:

two parallel sheets having lower and upper ends and having an internal joint pattern for forming parallel air cells, and passageways connecting the cells sequentially from a first lower cell through the passageways and successive intermediate cells to the last upper cell at the upper end;

a pressurized air supply line connected to the first lower air cell;

an exhaust line connected to the last upper cell;

a pressurized air supply;

an air exhaust; and a fluidic switch connected to the pressurized air supply, the supply line, the exhaust line and the air exhaust and arranged to provide air flow from the air supply through a main outlet and arranged to direct air from the pressurized air supply through a control orifice to direct the air flow from the outlet to the supply line for filling the first lower air cell and the other air cells sequentially, and the exhaust line arranged to direct air flowing out of the air cells through the last upper air cell to an opening adjacent the outlet to direct the air flow from the outlet to the air exhaust and using the air emptying from the cells to deflect cell-filling air to an exhaust, then again sequentially filling the air cells, followed by emptying the air cells and repeating the sequences.

10. The apparatus of claim 9, wherein the plastic sheets form a mattress for a person's body or back or for wrapping around legs.

11. A method comprising massaging a body, back or limbs of a person by sequentially filling connected air cells then emptying the air cells and using the air emptying from the cells to deflect cell-filling air to an exhaust, then again sequentially filling the air cells, followed by emptying the air cells and repeating the sequences.

12. The method of claim 11, wherein the filling the air cells begins with a lower cell and continues upward in sequences through the connected cells, and wherein the emptying the air cells comprises flowing the air out of the cells through an upper cell.

13. The method of claim 12, further comprising providing an air pump and a fluidic switch having a main supply body for supplying cell filling air from the air pump through an outlet, the fluidic switch having a first leg for exhaust and a first arm adjacent the first leg for supplying control air to a main body outlet and directing the cell filling air away from the exhaust and toward a second leg of the switch and to the lower cell, and an air cell emptying line connected to the upper cell and to a second arm of the switch for directing the cell filling air away from the second leg and toward the first leg for exhaust.

14. The method of claim 12, wherein the filling comprises directing air flow through an air supply line to the lower cell, and the emptying comprises directing air from the upper cell to a cell emptying line.

15. The method of claim 14, further comprising supplying pressurized air flow through an outlet of a fluidic switch, directing the air flow to the supply line by flowing pressurized air through a control line, impinging on the air flow, and influencing the air flow to the supply line.

16. The method of claim 15, further comprising directing the air flow from the outlet to an exhaust by flowing the air from the emptying line toward the air flow from the outlet, impinging on the air flow, and influencing the air flow to the exhaust.

* * * * *